US012426681B2

(12) United States Patent
Klein

(10) Patent No.: US 12,426,681 B2
(45) Date of Patent: Sep. 30, 2025

(54) SOLE STRUCTURE FOR ARTICLE OF FOOTWEAR

(71) Applicant: NIKE, Inc., Beaverton, OR (US)

(72) Inventor: Ross Klein, Portland, OR (US)

(73) Assignee: NIKE, Inc.

( * ) Notice: Subject to any disclaimer, the term of this patent is extended or adjusted under 35 U.S.C. 154(b) by 11 days.

(21) Appl. No.: 17/848,670

(22) Filed: Jun. 24, 2022

(65) Prior Publication Data

US 2023/0000208 A1 Jan. 5, 2023

Related U.S. Application Data

(60) Provisional application No. 63/216,980, filed on Jun. 30, 2021.

(51) Int. Cl.
*A43B 13/18* (2006.01)
*A43B 13/12* (2006.01)

(52) U.S. Cl.
CPC ..... *A43B 13/189* (2013.01); *A43B 13/125* (2013.01)

(58) Field of Classification Search
CPC ... A43B 13/125; A43B 13/189; A43B 13/186; A43B 13/187; A43B 13/188; A43B 13/20; A43B 13/14; A43B 13/181; A43B 7/14; A43B 7/1495; A43B 7/24
See application file for complete search history.

(56) References Cited

U.S. PATENT DOCUMENTS 6,497,058 B2 * 12/2002 Dietrich ..... A43B 13/14 36/31
10,588,378 B2 * 3/2020 Groeneweg ..... A43B 23/227
2007/0107259 A1 * 5/2007 Kilgore ..... A43B 13/20 36/31
2009/0260259 A1 * 10/2009 Berend ..... A43B 7/1435 36/35 B
2010/0307032 A1 * 12/2010 Geer ..... A43D 3/02 36/47
2011/0302809 A1 * 12/2011 Kim ..... A43B 13/187 36/103

(Continued)

OTHER PUBLICATIONS

European Patent Office (AS ISA), International Search Report and Written Opinion for PCT App. No. PCT/US2022/035370, mailed Sep. 28, 2022.

*Primary Examiner* — Haley A Smith

(74) *Attorney, Agent, or Firm* — Honigman LLP; Matthew H. Szalach; Jonathan P. O'Brien

(57) ABSTRACT

A sole structure includes a foam element extending from a forefoot region to a heel region. A bottom surface of the foam element includes a recess formed in the forefoot region. The sole structure also includes a cushioning arrangement disposed in the recess of the foam element. The cushioning arrangement has a proximal end adjacent to the bottom surface of the foam element and a distal end formed on an opposite side of the cushioning arrangement than the proximal end, the cushioning arrangement including at least one medial bladder proximate to a medial side of the sole structure and at least one lateral bladder proximate to a lateral side of the sole structure. An outsole includes an anterior outsole and a posterior outsole attached to the bottom surface of the foam element and the distal end of the cushioning arrangement. The anterior outsole is spaced apart from the posterior outsole.

19 Claims, 9 Drawing Sheets

(56) References Cited

U.S. PATENT DOCUMENTS

| | | | | |
|---|---|---|---|---|
| 2017/0347747 | A1* | 12/2017 | Groeneweg | A43B 7/20 |
| 2018/0213886 | A1* | 8/2018 | Connell | A43B 13/141 |
| 2019/0320759 | A1* | 10/2019 | Conrad | A43B 13/186 |
| 2021/0145118 | A1* | 5/2021 | Campos, II | A43B 13/125 |
| 2021/0145119 | A1 | 5/2021 | Campos, II et al. | |

* cited by examiner

FIG. 9
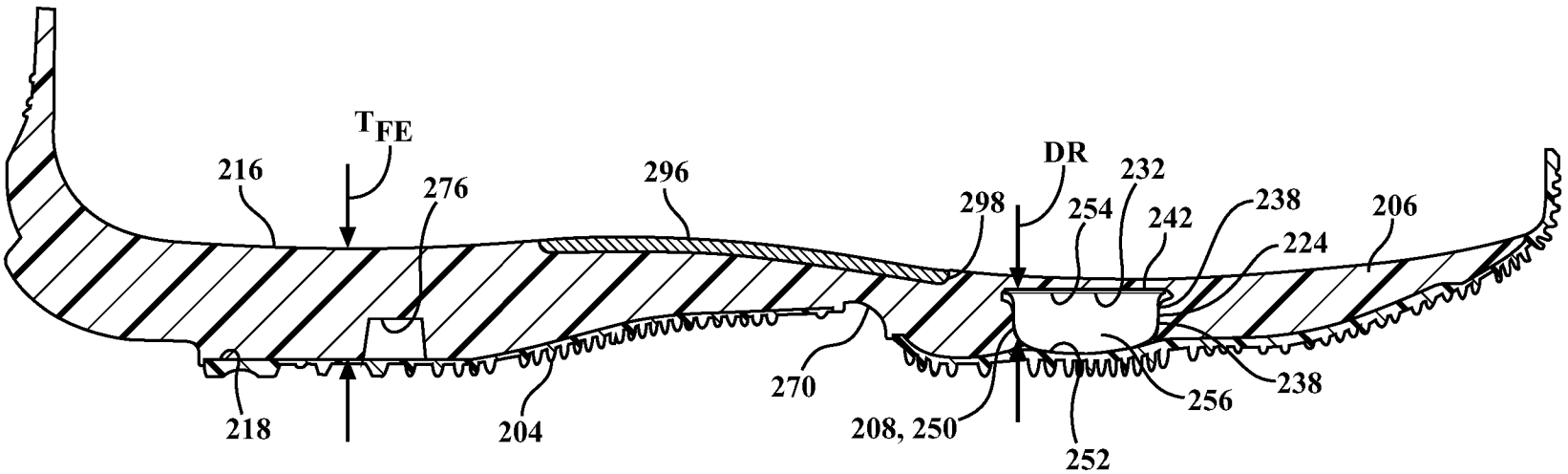
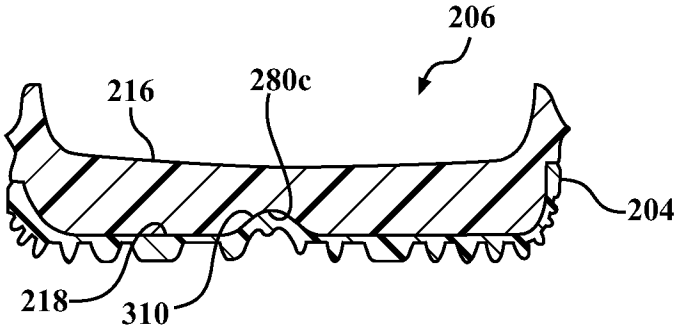
FIG. 10

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/216,980, filed on Jun. 30, 2021. The disclosure of this prior application is considered part of the disclosure of this application and is hereby incorporated by reference in its entirety.

FIELD

The present disclosure relates generally to sole structures for articles of footwear, and more particularly, to sole structures incorporating a cushioning arrangement and an outsole having an anterior outsole and a posterior outsole.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

FIG. 9 is a cross-sectional view of the sole structure of FIG. 8 taken along Line 9-9 of FIG. 8;

FIG. 10 is a cross-sectional view of the sole structure of FIG. 8 taken along Line 10-10 of FIG. 8;

Corresponding reference numerals indicate corresponding parts throughout the drawings.

DETAILED DESCRIPTION

Figure 1:
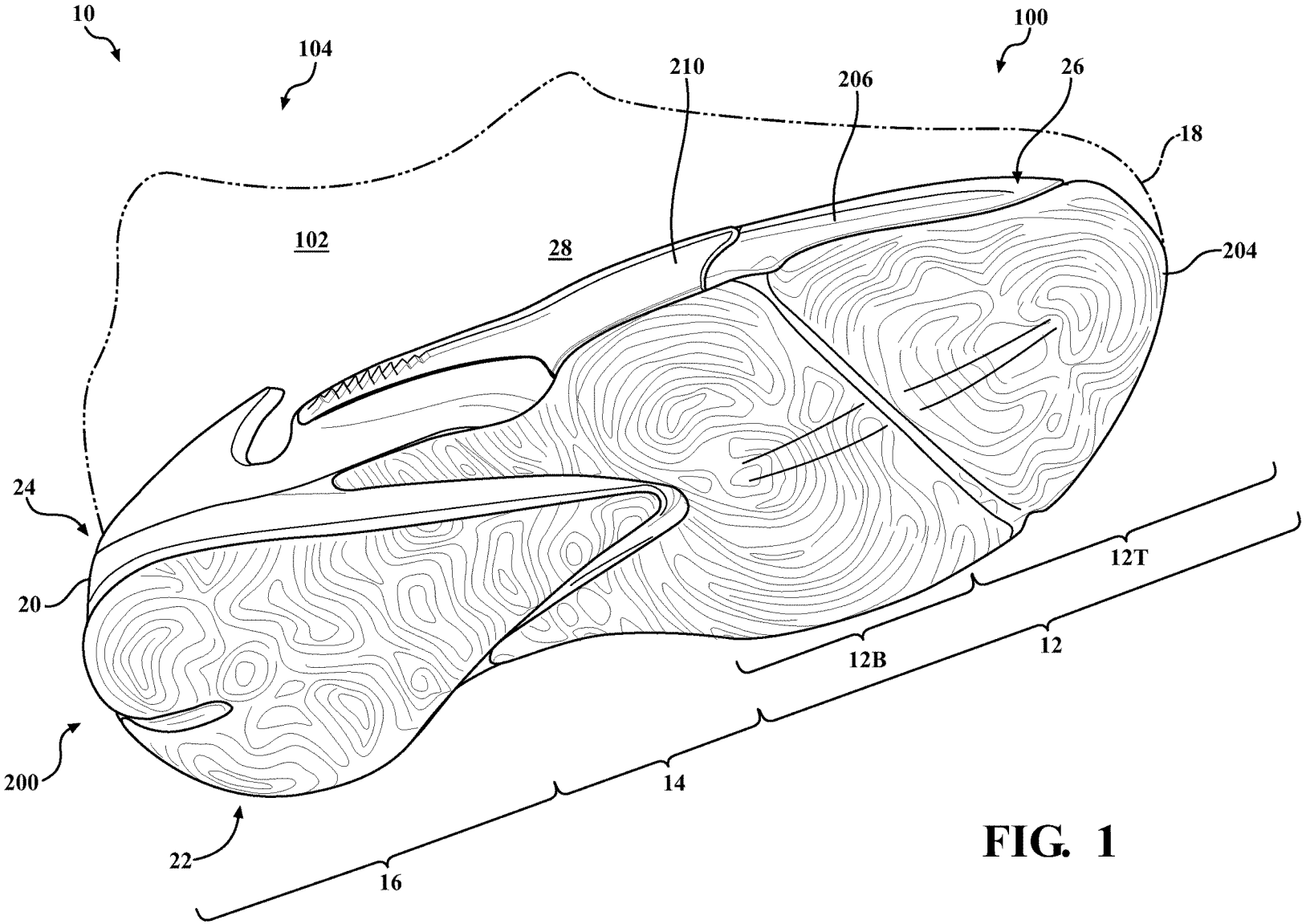
FIG. 1 is a perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having a heel region, a mid-foot region, a forefoot region, an interior region, and a peripheral region. The sole structure further includes a foam element extending from the forefoot region to the heel region and having a top surface and a bottom surface formed on an opposite side of the foam element from the top surface. The foam element includes a recess formed in the bottom surface in the forefoot region. The sole structure also includes a cushioning arrangement disposed in the recess of the foam element. The cushioning arrangement has a proximal end adjacent to the bottom surface of the foam element and a distal end formed on an opposite side of the cushioning arrangement than the proximal end. The cushioning arrangement includes at least one medial bladder proximate to a medial side of the sole structure and at least one lateral bladder proximate to a lateral side of the sole structure.

Implementations of the disclosure may include one or more of the following optional features. In some implementations, the at least one medial bladder is offset from the at least one lateral bladder along a longitudinal direction of the sole structure.

In some implementations, the cushioning arrangement includes at least one chamber having a tensile member disposed therein.

In some examples, the recess includes an intermediate surface opposing the at least one medial bladder and the at least one lateral bladder.

In some implementations, the at least one medial bladder and the at least one lateral bladder each includes a first barrier layer and a second barrier layer joined to each other to define a chamber, wherein the second barrier layer is planar and the intermediate surface of the recess is planar.

In some examples, the foam element has a heel thickness extending between the top surface and the bottom surface of the heel region of the foam element, the heel thickness being greater than a thickness of the cushioning arrangement.

In some implementations, the sole structure further includes a lateral support, and the foam element includes a lateral recess disposed on the lateral side of the sole structure and extends from the forefoot region to the mid-foot region. The lateral support is seated within the lateral recess.

In some implementations, the lateral support includes a base support and lateral wall. The base support is attached to the bottom surface of the foam element. The lateral wall includes an elongated portion extending from the lateral wall to a posterior end of the sole structure.

In some implementations, the sole structure further includes an outsole having an inner surface facing the foam element and the cushioning arrangement and an outer surface formed on an opposite side of the outsole than the inner surface. The outer surface defines a ground-engaging surface of the sole structure.

In some implementations, the outsole includes an anterior outsole and a posterior outsole spaced apart from the anterior outsole.

In some implementations, the anterior outsole includes a pair of wings spaced apart from each other and extending from a lateral side and a medial side of the anterior outsole, each of the pair of wings tapering to a point.

In some implementations, the posterior outsole includes a heel portion and a finger portion. The finger portion tapers away from the heel portion.

In some implementations, the heel portion of the posterior outsole includes a heel slit. In such an implementation, the heel slit may be open at a distal end of the heel portion and generally bisects the heel portion along a width of the heel portion.

In some implementations, the outsole is overmolded and encompasses each of the foam element and the cushioning arrangement.

Another aspect of the disclosure provides a sole structure for an article of footwear having a heel region, a mid-foot region, a forefoot region, an interior region, and a peripheral region, the sole structure comprising a foam element, a medial bladder, a lateral bladder, and an outsole. The foam element extends from the forefoot region to the heel region and includes a top surface and a bottom surface formed on an opposite side of the foam element than the top surface, the bottom surface defining a first portion of a ground-engaging surface of the sole structure in the forefoot region. The medial bladder is proximate to a medial side of the sole structure and the lateral bladder is proximate to a lateral side of the sole structure. The medial bladder and the lateral bladder are disposed within the recess. The outsole has an inner surface facing the foam element, the medial bladder, and the lateral bladder and an outer surface formed on an opposite side of the outsole than the inner surface. The outer surface defines a ground-engaging surface of the sole structure, wherein the outsole includes an anterior outsole and a posterior outsole spaced apart from the anterior outsole.

Implementations of the disclosure may include one or more of the following optional features. In some implementations, the anterior outsole includes a pair of wings spaced apart from each other and extends from a lateral side and a medial side of the anterior outsole, each of the pair of wings tapering to a point.

In some examples, the posterior outsole includes a heel portion and a finger portion. The finger portion tapers away from the heel portion. The heel portion of the posterior outsole includes a heel slit. In such an example, the heel slit may be open at a distal end of the heel portion and generally bisects the heel portion along a width of the heel portion.

In some implementations, the outsole is overmolded and encompasses each of the foam element, the medial bladder, and the lateral bladder.

Referring to FIG. 1, an article of footwear 10 includes an upper 100 and a sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone.

The footwear 10 may further include an anterior end 18 associated with a forward-most point of the forefoot region 12, and a posterior end 20 corresponding to a rearward-most point of the heel region 16. A longitudinal axis AF (shown in FIG. 8) of the footwear 10 extends along a length of the footwear 10 from the anterior end 18 to the posterior end 20, parallel to a ground surface. As shown, the longitudinal axis AF is centrally located along the length of the footwear 10, and generally divides the footwear 10 into a medial side 22 and a lateral side 24. Accordingly, the medial side 22 and the lateral side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the medial side 22 to the lateral side 24. A "width" may also be used to refer to the lateral direction. A "height" may refer to a direction that is orthogonal to both the longitudinal direction and the lateral direction.

The article of footwear 10, and more particularly, the sole structure 200, may be further described as including a peripheral region 26 and an interior region 28. The peripheral region 26 is generally described as being a region between the interior region 28 and an outer perimeter of the sole structure 200. Particularly, the peripheral region 26 extends from the forefoot region 12 to the heel region 16 along each of the medial side 22 and the lateral side 24, and wraps around each of the forefoot region 12 and the heel region 16. The interior region 28 is circumscribed by the peripheral region 26, and extends from the forefoot region 12 to the heel region 16 along a central portion of the sole structure 200. Accordingly, each of the forefoot region 12, the mid-foot region 14, and the heel region 16 may be described as including the peripheral region 26 and the interior region 28.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

In some examples, the upper 100 includes a strobel (not shown) having a bottom surface opposing the sole structure 200 and an opposing top surface (not shown) defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole (not shown) or sockliner that may be disposed upon the strobel and reside within the interior void 102 of the upper 100 to receive a plantar surface of the foot to enhance the comfort of the article of footwear 10. Referring again to FIG. 1, an ankle opening 104 in the heel region 16 may provide access to the interior void 102. For example, the ankle opening 104 may receive a foot to secure the foot within the void 102 and to facilitate entry and removal of the foot from and to the interior void 102.

In some examples, one or more fasteners (not shown) extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners. The fasteners may include laces, straps, cords, hook-and-loop, or any other suitable type of fastener. The upper 100 may include a tongue portion (not shown) that extends between the interior void 102 and the fasteners. It should be appreciated that the upper 100 described herein may be a conventional upper, or any current upper may be modified and adapted for use with the sole structure 200 described below.

Figure 2:
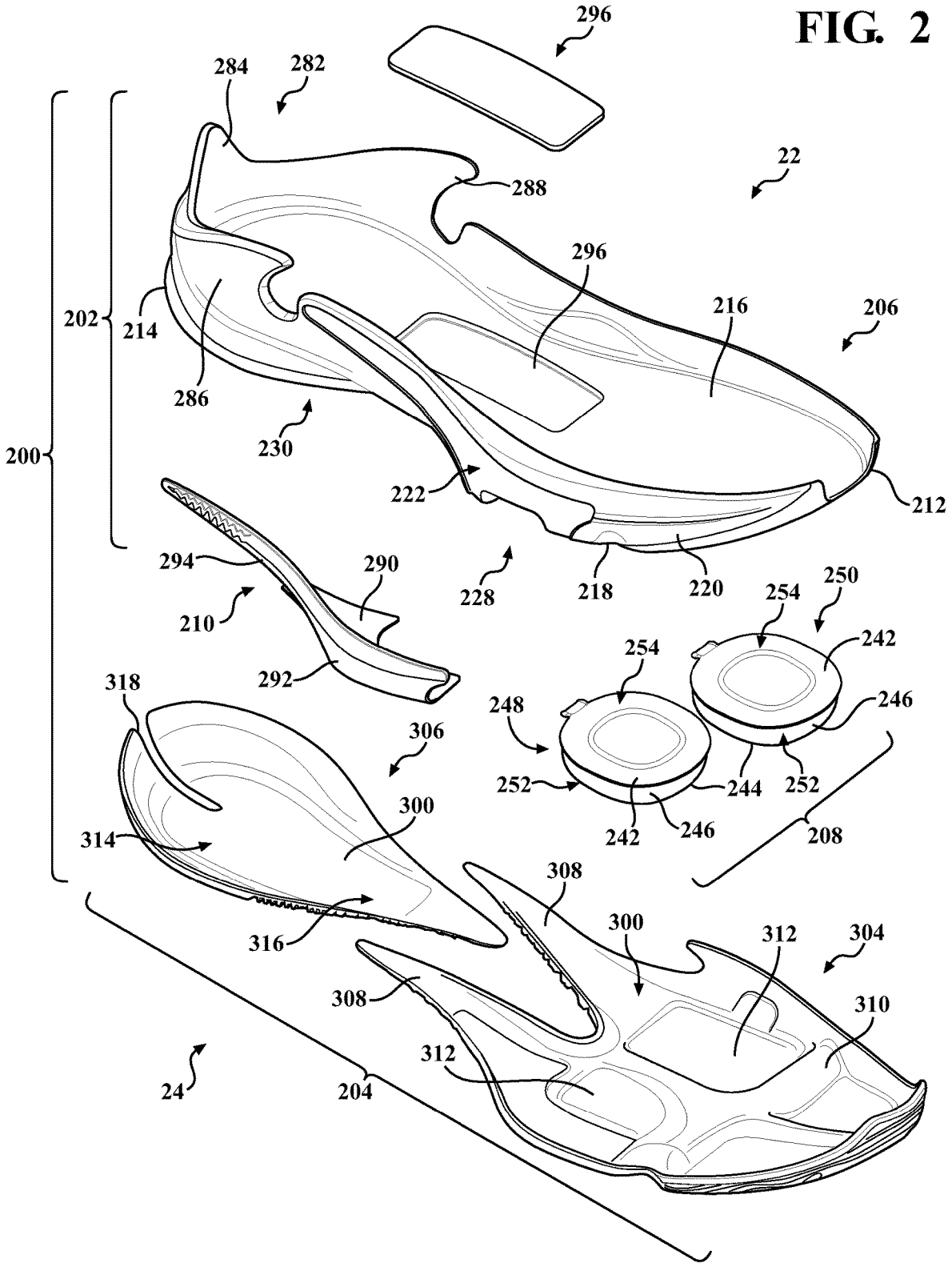
FIG. 2 is a top exploded view of a sole structure of the article of footwear of FIG. 1.

With reference to FIG. 2, the sole structure 200 includes a midsole 202 configured to provide cushioning characteristics to the sole structure 200, and an outsole 204 configured to provide a ground-engaging surface 30 of the article of footwear 10. Unlike conventional sole structures formed of a unitary midsole having a unitary outsole attached thereto, the midsole 202 is formed compositely and comprises a plurality of subcomponents for providing zonal cushioning and performance characteristics. For example, the midsole 202 includes a foam element 206, a cushioning arrangement or cushions 208, and a lateral support 210. The subcomponents 206, 208, 210 of the midsole 202 are assembled and secured to each other using various methods of bonding, including adhesively bonding and melding, for example. As described in greater detail below, the outsole 204 is overmolded onto the subcomponents 206, 208, 210 of the midsole 202, whereby the midsole 202 defines a profile of the ground-engaging surface 30 of the footwear 10.

The foam element 206 may be formed of a resilient polymeric material, such as foam or rubber, to impart properties of cushioning, responsiveness, and energy distribution to the foot of the wearer. The foam element 206 may independently be formed from a single unitary piece of resilient polymeric material, or may be formed of a plurality of elements each formed of one or more resilient polymeric materials. For example, the plurality of elements may be affixed to each other using a fusing process, using an adhesive, or by suspending the elements in a different resilient polymeric material. Alternatively, the plurality of elements may not be affixed to each other, but may remain independent while contained in one or more structures forming the cushioning element. In this alternative example, the plurality of independent foam elements may be a plurality of foamed particles, and may contained in a bladder or shell structure. As such, the foam element may be formed of a plurality of foamed particles contained within a relatively translucent bladder or shell formed of a film such as a barrier membrane.

Example resilient polymeric materials for the foam element may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed below for barrier layers. Alternatively, the one or more polymers may include one or more natural and/or synthetic rubbers, such as butadiene and isoprene.

The foam element 206 may be formed by a polymeric material that may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some configurations, the foamed polymeric material may be a cross-linked foamed material. In these configurations, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 11:
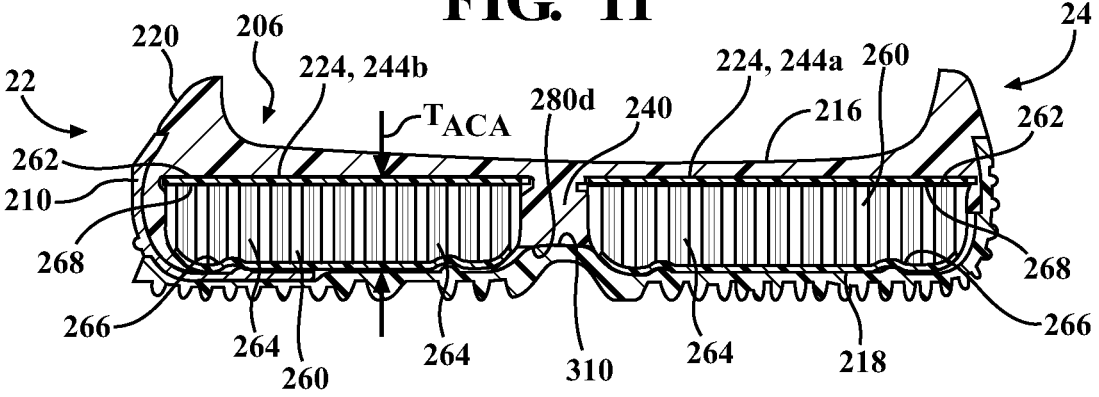
FIG. 11 is a cross-sectional view of the sole structure of FIG. 8 taken along Line 11-11 of FIG. 8.

With reference again to FIG. 2, the foam element 206 extends from a first end 212 at the anterior end 18 of the footwear 10 to a second end 214 at the posterior end 20 of the footwear 10. Accordingly, the foam element 206 extends along an entire length of the footwear 10. The foam element 206 further includes a top surface 216 and a bottom surface 218 formed on an opposite side of the foam element 206 than the top surface 216. The top surface 216 of the foam element 206 is configured to oppose the strobel of the upper 100, and may be contoured to define a profile of the footbed corresponding to a shape of the foot. As shown in FIG. 11, a distance between the top surface 216 and the bottom surface 218 defines a thickness $T_{FE}$ of the foam element 206, which is variable along the length of the sole structure 200.

The foam element 206 further includes a peripheral side surface 220 extending between the top surface 216 and the bottom surface 218. The peripheral side surface 220 generally defines an outer periphery of the sole structure 200. As shown in FIG. 2, the peripheral side surface 220 of the foam element 206 is configured to cooperate with the lateral support 210 to position the lateral support 210 to provide support for the arch area of the foot corresponding to the metatarsal and tarsal of the foot. Particularly, the peripheral side surface 220 includes a lateral recess 222 disposed on the lateral side 24 of the ball portion 12B and the mid-foot region 14 of the foam element 206.

With continued reference to FIG. 2, the lateral recess 222 extends from the bottom surface 218 of the foam element 206 and along the peripheral surface 220. The lateral recess 222 has a geometry configured to fittingly receive the lateral support 210. The lateral support 210 may be fixedly attached to the lateral recess 222 using any fastening techniques currently known or later developed, to include adhesives, molding, vibrational welding or the like. Once inserted into the lateral recess 222, the lateral support 210 may include an outer surface that is substantially flush with an outer surface of the peripheral surface 220 at least at a junction of the lateral support 210 and the peripheral surface 220. See, for example, FIGS. 4, 7, 11, and 12.

Figure 3:
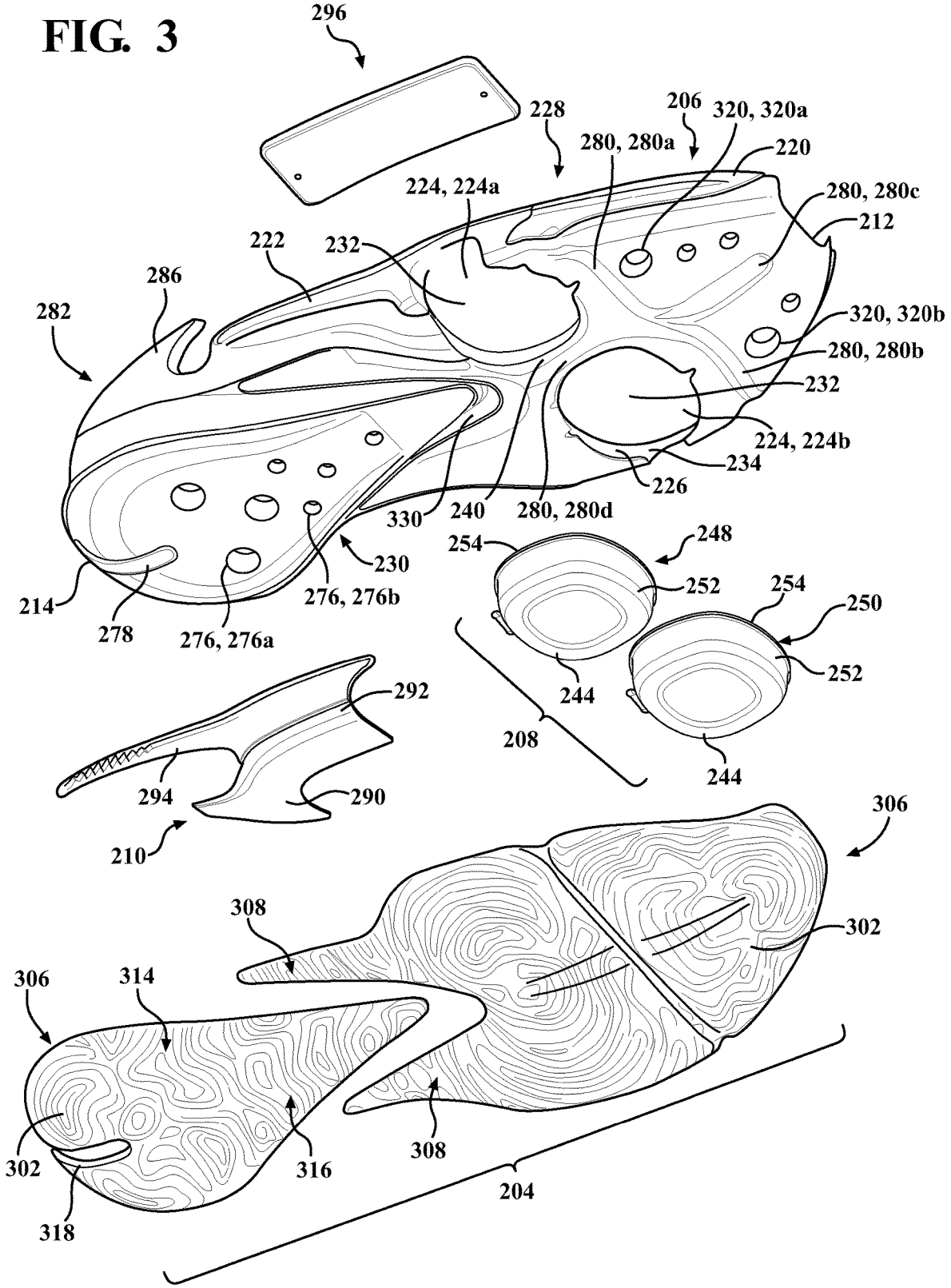
FIG. 3 is a bottom exploded view of the sole structure of FIG. 2.

The foam element 206 includes a cushion recess 224 configured to receive the cushioning arrangement 208 therein. As shown in FIG. 3, the cushion recess 224 is formed in the forefoot region 12 of the sole structure 200 and is defined by a peripheral sidewall 226 extending from the bottom surface 218 of the foam element 206 towards the top surface 216. Generally, the cushion recess 224 separates the foam element 206 into an anterior segment 228 and a posterior segment 230. The anterior segment 228 extends between the cushion recess 224 and the first end 212 of the foam element 206, while the posterior segment 230 extends between the cushion recess 224 and the second end 214 of the foam element 206.

In the illustrated example, the peripheral sidewall 226 of the cushion recess 224 extends partially from the bottom surface 218 to the top surface 216 and terminates at an intermediate surface 232 disposed between the bottom surface 218 and the top surface 216. Thus, a depth DR (shown in FIG. 9) of the cushion recess 224, measured from the bottom surface 218 to the intermediate surface 232, extends only partially through the thickness $T_{FE}$ of the foam element 206. Here, the anterior segment 228 and the posterior segment 230 of the foam element 206 are connected to each other by the portion of the foam element 206 formed between the intermediate surface 232 and the top surface 216. Accordingly, the foam element 206 may be formed as a unitary structure extending from the forefoot region 12 to the heel region 16. The foam element 206 at the heel region 16 is a unitary body wherein the peripheral surface 220 at the heel region 16 defines the width of the sole structure 200.

In some examples, the peripheral side wall 226 of the cushion recess 224 intersects with the peripheral surface 220 of the foam element 206 to define an opening 234 into the cushion recess 224 through the peripheral side surface 220 of the foam element 206. As shown in FIG. 3, the peripheral sidewall 226 may only partially intersect the peripheral side surface 220 of the foam element 206, whereby the opening 234 does not fully expose the cushion recess 224 through the peripheral side surface 220. As shown in FIG. 9, a lower portion 236 of the peripheral sidewall 226 may intersect the peripheral side surface 220 to define the opening 234, while an upper portion 238 of the peripheral sidewall 226 is spaced apart from the peripheral side surface 220. Accordingly, the upper portion 238 of the peripheral sidewall 226 completely surrounds the cushion recess 224, while the lower portion 236 of the peripheral sidewall 226 extends only partially around the cushion recess 224. As shown in FIG. 1, the opening 234 on the lateral side 24 of the sole structure 200 is covered by the lateral support 210.

Referring again to FIG. 3 and now to FIG. 11, in some examples, the sole structure 200 may include a pair of cushion recesses 224*a*, 224*b* configured to receive components of the cushioning arrangement 208. The cushion recess 224*a*, 224*b* may be referenced herein collectively as cushion recess 224 and individually as 224*a*, 224*b* as the case may be. For example, where the cushioning arrangement 208 is formed of a fragmentary structure, separate portions of the cushioning arrangement (i.e., individual cushions) 208 may be received by a corresponding one of the pair of cushion recesses 224. In particular, the foam element 206 includes a lateral cushion recess 224*a* and a medial cushion recess 224*b*. The lateral cushion recess 224*a* is disposed on the lateral side 24 of the sole structure 200 and the medial cushion recess 224*b* is disposed on the medial side 22 of the sole structure 200. An intermediate wall 240 of the foam element 206 separates the medial cushion recess 224*b* from the lateral cushion recess 224*a*. As shown, a profile of each of the cushion recesses 224*a*, 224*b* is defined by the peripheral sidewall 226 of the cushion recess 224 and corresponds to an outer peripheral profile of the cushioning arrangement 208. In some examples, the cushion recesses 224*a*, 224*b* are defined by the upper portion 238 of the peripheral sidewall 226, whereby the upper portion 240 of the peripheral sidewall 226 contacts the cushioning arrangement 208, such that each cushion recess 224*a*, 224*b* is substantially filled by the cushioning arrangement 208.

Referring again to FIGS. 2, 3, and 11 and now also to FIG. 9, the cushioning arrangement 208 is configured to be disposed within the cushion recess 224 of the foam element 206, in the forefoot region 12 of the sole structure 200. The cushioning arrangement 208 includes a top surface 242 and a bottom surface 244 formed on an opposite side of the cushioning arrangement 208 from the top surface 242, whereby a distance between the top surface 242 and the bottom surface 244 defines a thickness $T_{ACA}$ of the cushioning arrangement 208 (shown in FIG. 11). When assembled within the sole structure 200, the top surface 242 is adjacent and attaches to the intermediate surface 232 of the cushion recess 224 while the bottom surface 244 faces away from the intermediate surface 232 of the cushion recess 224. Accordingly, the top surface 242 may be referred to as a proximal end of the cushioning arrangement 208, while the bottom surface 244 may be referred to as a distal end of the cushioning arrangement 208. An outer peripheral surface 246 extends between the top surface 242 and the bottom surface 244 and defines an outer peripheral profile of the cushioning arrangement 208.

In the illustrated example, the cushioning arrangement 208 is formed as a fragmentary structure and includes a pair of bladders 248, 250 arranged to provide cushioning in the forefoot region 12 of the sole structure 200. As shown in the cross-sectional view of FIG. 11, the bladders 248, 250 may be formed by a first barrier layer 252 and a second barrier layer 254, which can be joined to each other at discrete locations to define an overall shape of the bladder 248, 250. Alternatively, the bladders 248, 250 can be produced from any suitable combination of one or more barrier layers 252, 254. As used herein, the term "barrier layer" (e.g., barrier layers 252, 254) encompasses both monolayer and multilayer films. In some configurations, one or both of the barrier layers 252, 254 are each produced (e.g., thermoformed or blow molded) from a monolayer film (a single layer). In other configurations, one or both of the barrier layers 252, 254 are each produced (e.g., thermoformed or blow molded) from a multilayer film (multiple sublayers). In either aspect, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

One or both of the barrier layers 252, 254 can independently be transparent, translucent, and/or opaque. As used herein, the term "transparent" for a barrier layer and/or a bladder means that light passes through the barrier layer in substantially straight lines and a viewer can see through the barrier layer 252, 254. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 252, 254 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocyanurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular aspects, the polyurethane polymer chains are produced from diisocyanates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 252, 254 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In configurations where the barrier layers 252, 254 include two or more sublayers, examples of suitable multilayer films include microlayer films, such as those disclosed in Bonk et al., U.S. Pat. No. 6,582,786, which is incorporated by reference in its entirety. In further configurations, the barrier layers 252, 254 may each independently include alternating sublayers of one or more TPU copolymer materials and one or more EVOH copolymer materials, where the total number of sublayers in each of the barrier layers 252, 254 includes at least four (4) sublayers, at least ten (10) sublayers, at least twenty (20) sublayers, at least forty (40) sublayers, and/or at least sixty (60) sublayers.

The bladders 248, 250 can be produced from the barrier layers 252, 254 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 252, 254 can be produced by co-extrusion followed by vacuum thermoforming to form the profile of the bladders 248, 250, which can optionally include one or more valves (e.g., one way valves) that allows the fluid-filled chamber 256 of the bladders 248, 250 to be filled with the fluid (e.g., gas).

The fluid-filled chamber 256 of the bladders 248, 250 desirably have a low gas transmission rate to preserve its retained gas pressure. In some configurations, the fluid-filled chamber 256 has a gas transmission rate for nitrogen gas that is at least about ten (10) times lower than a nitrogen gas transmission rate for a butyl rubber layer of substantially the same dimensions. In one aspect, fluid-filled chamber 256 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 252, 254). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

One of the pair of bladders 248, 250 is a lateral bladder 248 and the other is a medial bladder 250. The lateral bladder 248 and the medial bladder 250 are shown as being generally the same shape and size as each other. However, it should be appreciated that the medial bladder 250 and the lateral bladder 248 may be dimensioned differently from each other. The bladders 248, 250 may be arranged in a side-by-side relationship extending along the lateral direction of the sole structure 200.

As discussed above and best illustrated in FIGS. 3 and 11, the foam element 206 includes a pair of cushion recesses 224*a*, 224*b* configured to receive the lateral bladder 248 and the medial bladder 250, respectively, of the cushioning arrangement 208. For example, in the illustrated example, the lateral recess 224*a* receives the lateral bladder 248 and the medial recess 224*b* receives the medial bladder 250. In the illustrated example, where the cushion recesses 224 are formed only by the upper portion 240 of the peripheral sidewall 226, the entirety of the lateral bladder 248 and the medial bladder 250 is disposed within a respective lateral recess 224*a* and medial recess 224*b*.

As described above, the first barrier layer 252 and the second barrier layer 254 cooperate to define a geometry (e.g., thicknesses, width, and lengths) of the chamber 256. For example, the peripheral seam 258 bounds the chamber 256 to seal the fluid (e.g., air) within the chamber 256. Thus, the chamber 256 is associated with an area of the corresponding bladder 248, 250 where interior surfaces of the first barrier layer 252 and the second barrier layer 254 are not joined together and, thus, are separated from one another. In the illustrated example, an outer peripheral profile of the chamber 256 has a cross-sectional shape corresponding to a rounded square, as best shown in FIGS. 9 and 11.

In the illustrated example, the first barrier layer 252 is cup-shaped and defines a height of the bladder 248, 250, while the second barrier layer 254 is planar and defines a cover of the bladder 248, 250. As shown in FIG. 11, the substantially planar second barrier layer 254 of the bladder 248, 250 opposes the substantially planar surface of the intermediate surface 232 of a corresponding cushion recess 224*a*, 224*b*.

As shown in the figures, a space formed between opposing interior surfaces of the first barrier layer 252 and the second barrier layer 254 defines an interior void 260 of the chamber 256. The interior void 260 of the chamber 256 may receive a tensile element 262 therein. FIG. 11 depicts an illustrative example wherein the chamber 256 receives a tensile element 262 whereas FIG. 9 depicts an example wherein the chamber 256 is void of a tensile element 262. As shown in FIG. 11, each tensile element 262 may include a series of tensile strands 264 extending between a first tensile sheet 266 and a second tensile sheet 268. The first tensile sheet 266 may be attached to the first barrier layer 252 while the second tensile sheet 268 may be attached to the second barrier layer 254. In this manner, when the chamber 256 receives the pressurized fluid, the tensile strands 264 of the tensile element 262 are placed in tension. Because the first tensile sheet 266 is attached to the first barrier layer 252 and the second tensile sheet 268 is attached to the second barrier layer 254, the tensile strands 264 retain a desired shape of the bladder 248, 250 when the pressurized fluid is injected into the interior void 260. For example, in the illustrated implementations, the tensile element 262 maintains substantially planar first and second barrier layers 252, 254, thereby allowing the bladders 248, 250 to be generally flush against the intermediate surface 232 of a respective cushion recess 224*a*, 224*b*. Furthermore, by maintaining the second barrier layer 256 substantially planar, the top surface 242 of the cushioning arrangement 208 does not protrude into the intermediate surface 232 of the cushion recess 224*a*, 224*b*, thereby providing a generally smooth surface that may provide comfort to the wearer during use. Additional details of tensile element 262 are described in U.S. Pat. Nos. 4,906,502, 5,083,361, and 6,385,864, the disclosures of which are fully incorporated herein by reference. Alternatively, a foam structure, not shown, may be disposed within the interior void 124*a*.

In some examples, the interior void 260 is at a pressure ranging from 15 psi (pounds per square inch) to 25 psi. In other examples, the interior void 260 may have a pressure ranging from 20 psi to 25 psi. In some examples, the interior void 260 has a pressure of 20 psi. In other examples, the interior void 260 has a pressure of 25 psi. As provided above, where a plurality of bladders 248, 250 form the cushioning arrangement 208, the interior voids 262 of each of the bladders 248, 250 may be pressurized differently from each other.

With reference to again to FIG. 3, the bottom surface 218 of the posterior segment 230, which includes the heel region 16 of the foam element 206, is generally bulbous. The posterior segment 230 has a heel thickness $T_{FE}$ extending between the top surface 216 and the bottom surface 218 of the heel region 16 that is greater than a thickness Tc of the cushioning arrangement 208. The posterior segment 230 of the foam element 206 is further separated from the anterior segment 228 of the foam element 206 by a V-shaped groove 270. The V-shaped groove 270 is a continuous indentation in the foam element 206, which is in the shape of a "V." The V-shaped groove 270 is open towards the second end 214 of the foam element 206. Each end of the V-shaped groove 270 terminates at the medial side 22 and lateral side 24 of the foam element 206. The V-shaped groove 270 defines a tapered portion 272 that tapers in three-dimensional space from the second end 214 towards the first end 212. The tapered portion 272 is raised from the bottom surface 218 relative to the V-shaped groove 270. The V-shaped groove 270 provides the foam element 206 and the sole structure 200 with a flexibility about the longitudinal direction of the sole structure 200 (e.g. allows the sole structure 200 to flex or twist about the longitudinal direction of the sole structure 200). The posterior segment 230 further includes a head portion 274 disposed at the second end 214 of the foam element 206 and is contiguous with the tapered portion 272.

A plurality of posterior holes 276 are disposed in the posterior segment 230 of the foam element 206. The posterior holes 276 are configured to facilitate a compression of the foam element 206 at the heel region 16. The posterior holes 276 may be dimensioned differently from each other. In one aspect, as shown in FIG. 3, the posterior holes 276 include a plurality of first posterior holes 276*a* and a plurality of second posterior holes 276*b*. The first posterior holes 276*a* are greater in diameter than the second posterior holes 276*b*. Each of the posterior holes 276*a*, 276*b* are closed at one end by the foam element 206. In one aspect, the foam element 206 includes three first posterior holes 276*a* each having the same diameter as the other. The first posterior holes 276*a* are generally equidistant from each other and arranged to form a generally triangular shape. In another aspect, the foam element includes four second posterior holes 276*b*, each of the second posterior holes 276*b* has the same diameter as the other. The second posterior holes 270*b* are arranged in a generally "Y" shaped dimension. The first posterior holes 276*a* are generally centered within the heel region 16. As the first posterior holes 276*a* are greater in diameter relative to the second posterior holes 276*b*, the area surrounding the first posterior holes 276*a* have a greater compression relative to the area surrounding the second posterior holes 276*b*. This configuration allows the impact forces associated with an initial heel strike to be absorbed by the posterior segment 230 and distributed through the posterior segment 230, while forces are more evenly distributed among the foam element 206 as the foot transitions through the mid-foot region 14. Within the forefoot region 12, the cushioning and performance properties of the cushioning arrangement 208 are imparted to the ground-engaging surface 30. Particularly, forces associated with pushing off of the forefoot during running or jumping motions are absorbed by the cushioning arrangement 208.

The foam element 206 may further include a heel groove 278. The heel groove 278 is defined by a continuous indentation formed in the foam element 206. The heel groove 278 extends substantially along the longitudinal axis of the sole structure 200. The heel groove 278 is disposed on the second end 214 of the foam element 206 and is generally centered between the medial side 22 and the lateral side 24. The heel groove 278 begins at the second end 214 of the foam element and terminates at an intermediate portion of the heel region 16. The heel groove 278 facilitates a compression of the foam element 206 in response to a heel strike. In addition, the heel groove 278 provides the foam element with a lateral expansion in response to a heel strike.

The anterior segment 228 of the foam element 206 includes a cross-groove 280. The cross-groove 280 is a continuous indentation in the foam element 206 in the shape of a cross. The cross-groove 280 includes a lateral leg 280*a*, a medial leg 280*b*, an anterior leg 280*c*, and a posterior leg 280*d*. The lateral leg 280*a* and the medial leg 280*b* are disposed between the cushion recess 224 and the first end 212 of the foam element 206, and generally separates the ball portion 12B from the toe portion 12T of the sole structure 200. The lateral leg 280*a* and the medial leg 280*b* extend generally from a center of the anterior segment 228 to corresponding lateral and medial sides 24, 22. The lateral leg 280*a* and the medial leg 280*b* may be offset from each other in the longitudinal direction of the foam element 206. The anterior leg 280*c* and the posterior leg 280*d* extend generally from a center of the anterior segment 228 towards the first end 212 and the second end 214, respectively. The anterior leg 280*c* generally divides the toe portion 12T of the foam element 206 in half. The posterior leg 280*d* is disposed on the intermediate wall 240 of the foam element 206 and is offset from the anterior leg 280*c* in the lateral direction of the foam element 206. Within the forefoot region 12, the cushioning and performance properties of the cushioning arrangement 208 are imparted to the ground-engaging surface 30.

The anterior segment 228 may further include a series of anterior holes 320. In one aspect, the anterior segment 228 includes a lateral series of anterior holes 320*a* and a medial series of anterior holes 320*b*. The lateral series of anterior holes 320*a* and the medial series of anterior holes 320*b* may be configured to have different number of holes. The anterior leg 280*c* is disposed generally equidistant between the lateral series of anterior holes 320*a* and the medial series of anterior holes 320. In one aspect, the holes increase in diameter from the front end 212 of the foam element to the second end 214 of the foam element. The series of anterior holes 320 are configured to facilitate the compression of the anterior segment 228 of the foam element. Particularly, forces associated with pushing off of the forefoot during running or jumping motions are absorbed by the cushioning arrangement 208. Further, the cross-groove 280 provides for flexibility in the foam element with respect to lateral impact forces associated with pivoting, juking and the like.

Referring to the cross-sectional view of FIG. 9, when the sole structure 200 is assembled, each posterior segment 230 of the foam element 206, and the cushioning arrangement 208 cooperate to define a profile of the ground-engaging surface 30. As used herein, the midsole 202 is referred to as defining the profile of the ground-engaging surface 30, while the outsole 204 actually forms the ground-engaging surface 30. For example, the shape of the ground-engaging surface 30 is determined by the midsole 202 and the outsole 204 is overmolded onto the midsole 202 to provide wear resistance and traction properties.

As shown, a first portion of the ground-engaging surface 30 is defined by the anterior segment 228 of the foam element 206 in the toe portion 12T of the forefoot region 12. Here, the bottom surface 218 of the foam element 206 converges towards the top surface 216 along a direction from the cushion recess 224 to the anterior end 18 of the footwear 10. In the illustrated example, the bottom surface 218 is convex and curves towards the top surface 216 in the direction from the cushion recess 224 to the anterior end 18. Accordingly, the anterior segment 228 of the foam element 206 provides an arcuate toe portion 12T of the sole structure 200.

Referring still to FIG. 9, a second portion of the ground-engaging surface 30 is defined by the cushioning arrangement 208 in the ball portion 12B of the forefoot region 12. As discussed above, the cushioning arrangement 208 includes a medial bladder 250 and a lateral bladder 248 arranged from the medial side 22 to the lateral side 24. The top surface 244 of the cushioning arrangement 208, collectively defined by the second barrier layer 252 of the lateral bladder 248 and the medial bladder 250, defines a proximal end of the cushioning arrangement 208 that is attached to the foam element 206. Likewise, the bottom surface 246 of the cushioning arrangement 208, collectively defined by the first barrier layer 252 of the lateral bladder 248 and the medial bladder 250, defines a distal end of the cushioning arrangement 208 and, consequently, a profile of the ground-engaging surface 30 in the ball portion 12B of the forefoot region 12.

The posterior segment 230 of the foam element 206 defines the ground-engaging surface 30 in the mid-foot region 14 and the heel region 16. More particularly, the posterior segment 230 extends substantially continuously from the medial side 22 to the lateral side 24 in the mid-foot region 14 and the heel region 16 so as to define the profile of the ground-engaging surface 30 in the peripheral region 26 of the mid-foot region 14 and the heel region 16 as well as the profile of the ground-engaging surface 30 in the interior region 28 of the mid-foot region 14 and the heel region 16.

Referring still to FIG. 9, the thickness $T_{FE}$ of the foam element 206 in the interior region 28 of the posterior segment 230 tapers along a direction from the cushion recess 224 to the posterior end 20 of the sole structure 200. Particularly, the thickness $T_{FE}$ of the foam element 206 is tapered such that the bottom surface 218 of the foam element 206 along the mid-foot region 14 is arc shaped to conform to the arch area of a foot.

With reference again to FIGS. 1-4, the foam element 206 further includes a heel counter 282 integrally formed to the posterior segment 230. The heel counter 282 extends over top surface 216 of the foam element 206 and the upper 100. As shown, the heel counter 282 extends from a first end on the lateral side 24, around the posterior end 20, and to the second end on the medial side 22. With reference to FIG. 1, a posterior support 284 of the heel counter 282 is generally triangular in shape and is disposed on the posterior end 20 of the foam element 206. A lateral heel support 286 extends from a lateral end of the posterior support 284 and a medial heel support 288 extends from a medial end of the posterior support 284. The ends of the lateral heel support 286 and the medial heel support 288 is a generally wave shaped structure having a "C" shaped end.

Figure 7:
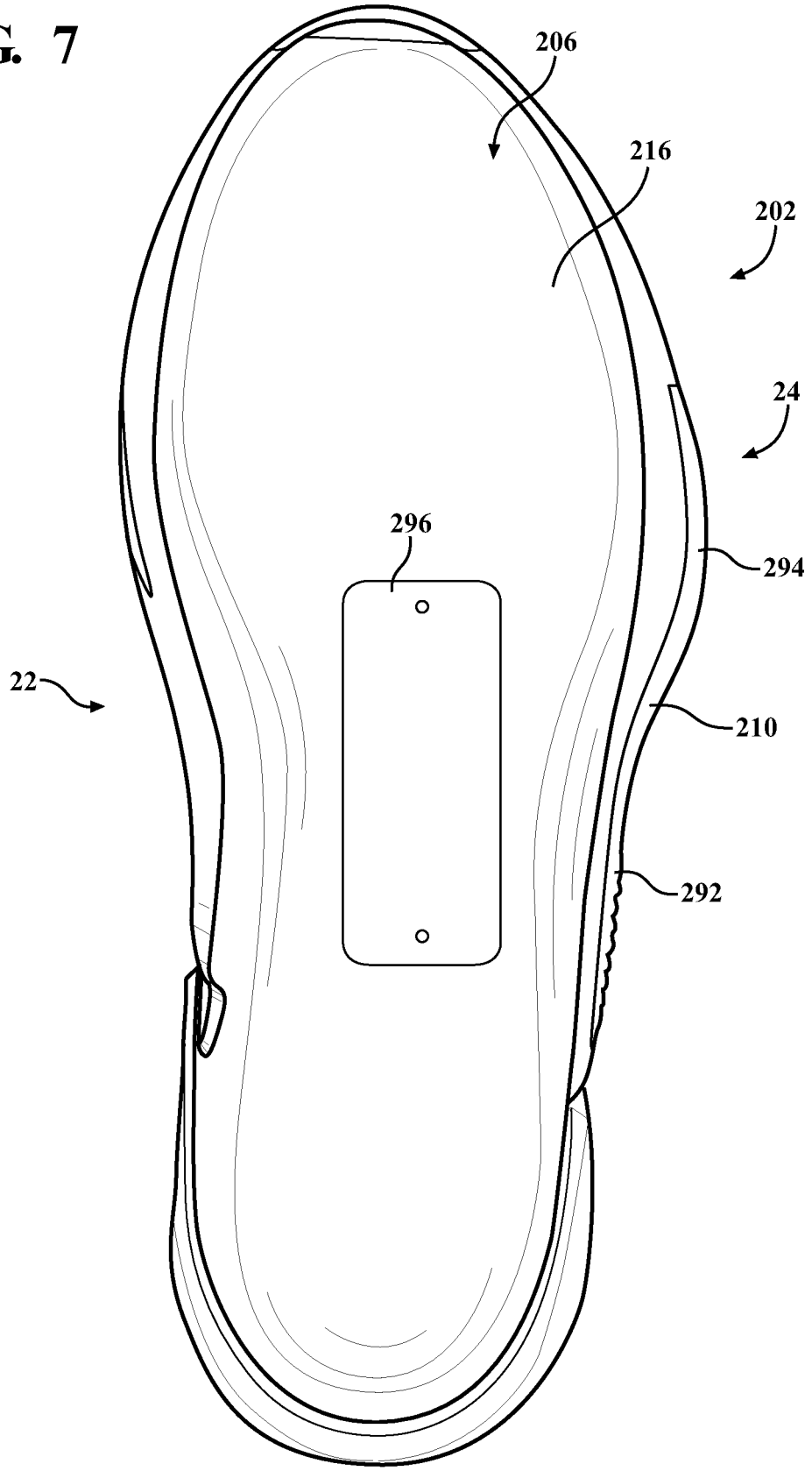
FIG. 7 is a top view of a sole structure in accordance with the principles of the present disclosure for use with the article of footwear of FIG. 1.

With reference now to FIGS. 2-6, a description of the lateral support 210 is provided. The lateral support 210 is configured to be seated within the lateral recess 222. The lateral support 210 includes a base support 290 and lateral wall 292 that may be integrally formed with one another and may be formed from a more rigid material than the material of the foam element 206. Accordingly, the lateral support 210 is more rigid than the foam element 206. The base support 290 is generally orthogonal to the lateral wall 292. The base support 290 is a generally planar member having an irregular "L" shaped geometry. When assembled, the base support 290 is positioned within the mid-foot region 14 of the sole structure 200 between the cushioning arrangement 208 and the outsole 204 (FIG. 11). The base support 290 is also attached to the lateral recess 222 at the bottom surface 218 of the foam element 206. The lateral wall 292 extends upwardly from a lateral side 24 of the base support 290 so as to support the arch area of the foot. The lateral wall 292 includes an elongated portion or projection 294 extending from the lateral wall 292 toward the posterior end 20 of the sole structure 200 (i.e., from the forefoot region 12 to the heel region 16). The elongated portion 294 extends upwardly and inwardly so as to support an upper side portion of the arch area of the foot, as shown in FIG. 7.

Figure 12:
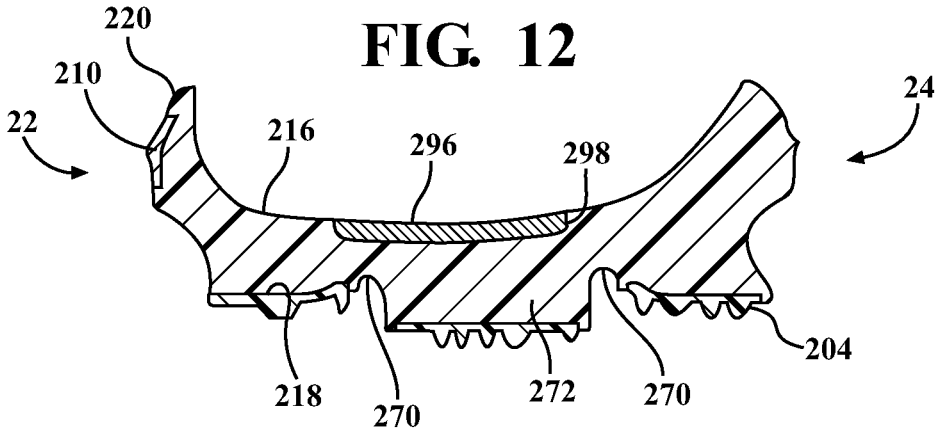
FIG. 12 is a cross-sectional view of the sole structure of FIG. 8 taken along Line 12-12 of FIG. 8.

With reference now to FIG. 2, the sole structure 200 may further include a mid-foot shank 296. The midfoot shank 296 is a generally planar member having a rigidity greater than the rigidity of the foam element 206. The midfoot shank 296 is preferably formed of a material configured to generate a return force in response to a heel to toe strike. The midfoot shank 296 is configured to be seated within a shank recess 298 disposed on the top surface 216 of the foam element 206. The midfoot shank 296 is generally centered within the mid-foot region 16 so as to support the arch area of the foot. The shank recess 298 has a depth configured to position the top surface of the midfoot shank 296 flush with the top surface 216 of the foam element 206 so as to provide a generally continuous or seamless surface, as depicted in FIGS. 7 and 12.

Figure 4:
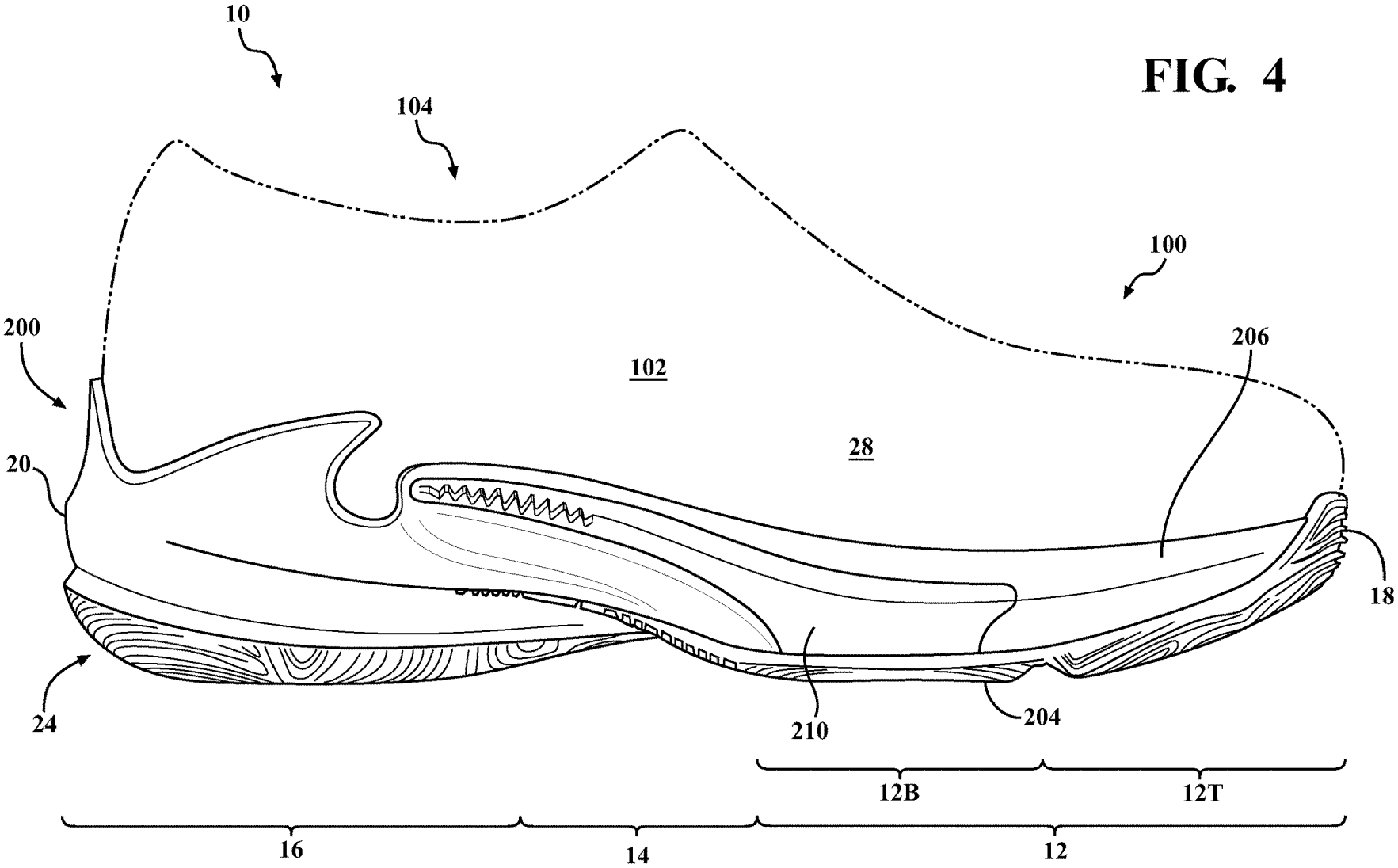
FIG. 4 is a side view of the article of footwear shown in FIG. 1.
Figure 5:
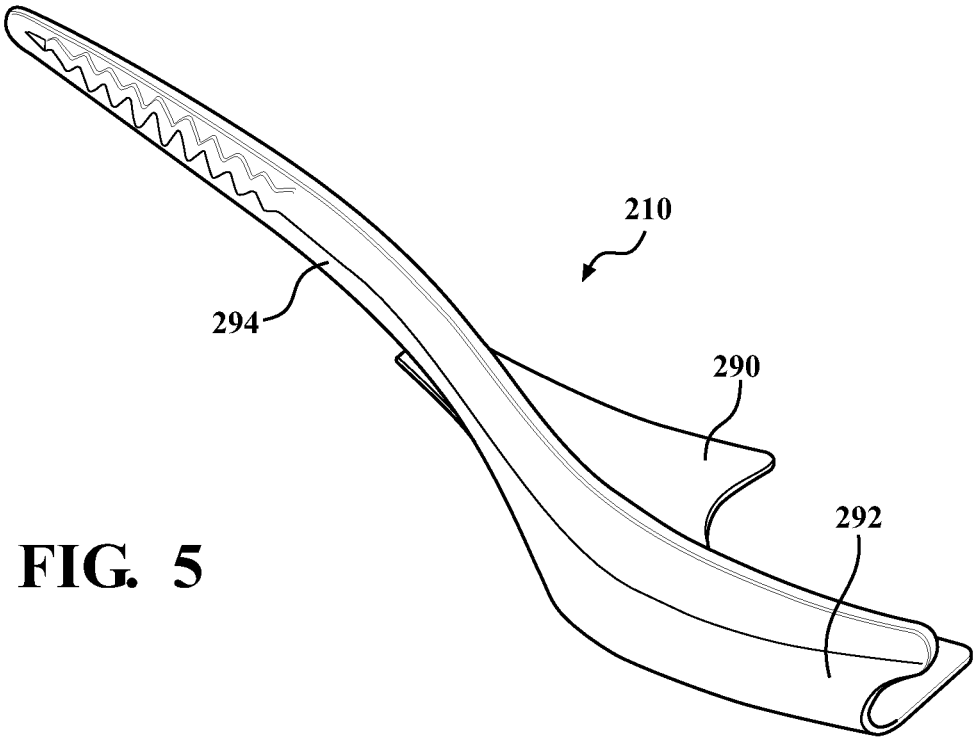
FIG. 5 is a top perspective view of a lateral support of the sole structure shown in FIG. 1.
Figure 6:
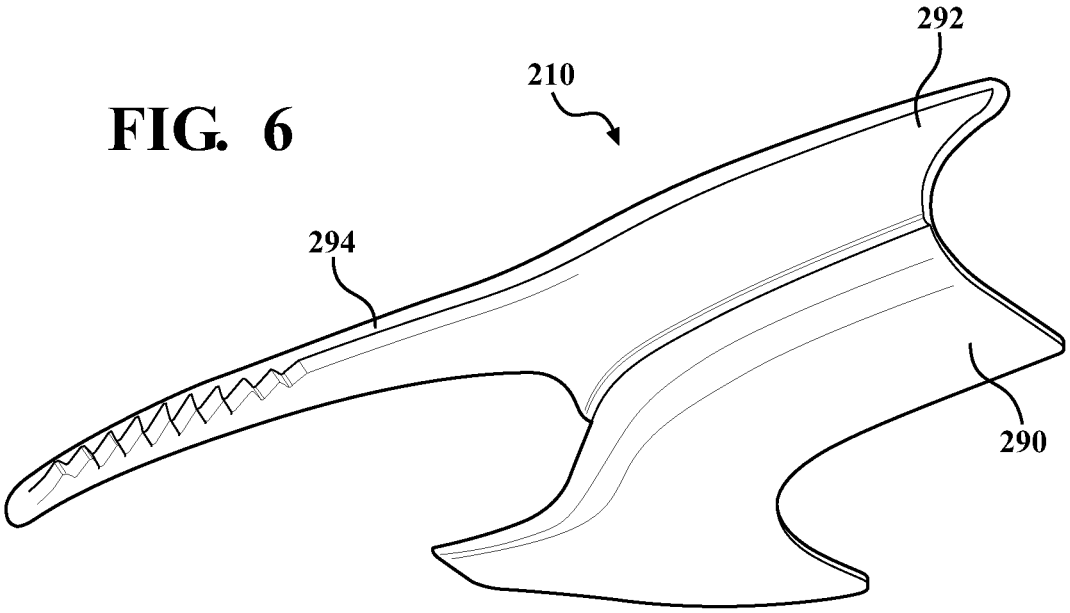
FIG. 6 is a bottom perspective view of a lateral support of the sole structure shown in FIG. 1.

In the illustrated example, the outsole 204 is formed integrally with the midsole 202 of using an overmolding process. Accordingly, the outsole 204 forms the ground-engaging surface 30 having a profile substantially similar to the profile defined by the cooperation of the various components 206, 208, and 210 of the midsole 202. The outsole 204 may be described has having an inner surface 300 configured to attach to the bottom surface 218 of the foam element 206, the bottom surface 246 of the cushioning arrangement 208, and the lateral support 210. An outer surface 302 of the outsole 204 is formed on an opposite side from the inner surface 300 and forms the ground-engaging surface 30 of the sole structure 200. Accordingly, the outsole 204 at least partially encompasses each of the foam element 206, the cushioning arrangement 208, and the base support 290 of the lateral support 210 such that the base support 290 extends between the cushioning arrangement 208 and the outsole 204 (FIG. 4). In so doing, the lateral support 210 extends around the cushioning arrangement 208 at the opening 234 on the lateral side 24 and is spaced apart from the cushioning arrangement 208 by a thickness of the foam element 206 adjacent to the opening 234 (FIG. 11). The outsole 204 is formed of a resilient material configured to impart properties of abrasion resistance and traction to the ground-engaging surface 30 of the sole structure 200. In other examples, the outsole 204 may be formed separately from the midsole 202 and adhesively bonded to midsole 202.

The outsole 204 includes an anterior outsole 304 and a posterior outsole 306 spaced apart from the anterior outsole 304. The anterior outsole 304 includes a pair of wings 308 spaced apart from each other and extending along the lateral side 24 and the medial side 22 of the anterior outsole 304. Each of the wings 308 taper to a point, and extend generally from the ball portion 12B to the mid-foot region 14 so as to support the metatarsal and tarsal of the foot. The anterior outsole 304 further includes a cross-bead 310 formed on the inner surface 300. The cross-bead 310 is a continuous bead formed on the inner surface 300 that is generally shaped as a cross. The cross-bead 310 has a height commensurate with the depth of the cross-groove 280 so as to form a flushed engagement between the cross-bead 310 and the cross-groove 280. The cross-bead 310 is configured to be seated into the cross-groove 280 of the anterior segment 228 of the foam element 206. The cross-bead 310 defines a pair of pockets 312 configured to receive the medial and lateral bladders 248, 250. With reference to FIG. 10, the cross-groove 280 is seated and directly contacting the toe portion 12T of the foam element 206 wherein the cross-groove 280 is seated within the anterior leg 280*c* of the cross-groove 280.

The posterior outsole 306 is generally tear-shaped. The posterior outsole 306 includes a heel portion 314 and a finger portion 316. The finger portion 316 tapers away from the heel portion 314. The heel portion 314 is configured to receive the head portion 274 of the posterior segment 230 and the finger portion 316 is configured to receive the tapered portion 272 of the posterior segment 230. The heel portion 314 is configured to cup the head portion 274 and includes a heel slit 318 configured to overlay the heel groove 278 of the posterior segment 230 so as to expose the heel groove 278. The heel slit 318 is open at a distal end of the heel portion 314 and generally bisects the heel portion 314 along a width of the heel portion 314.

Figure 13:
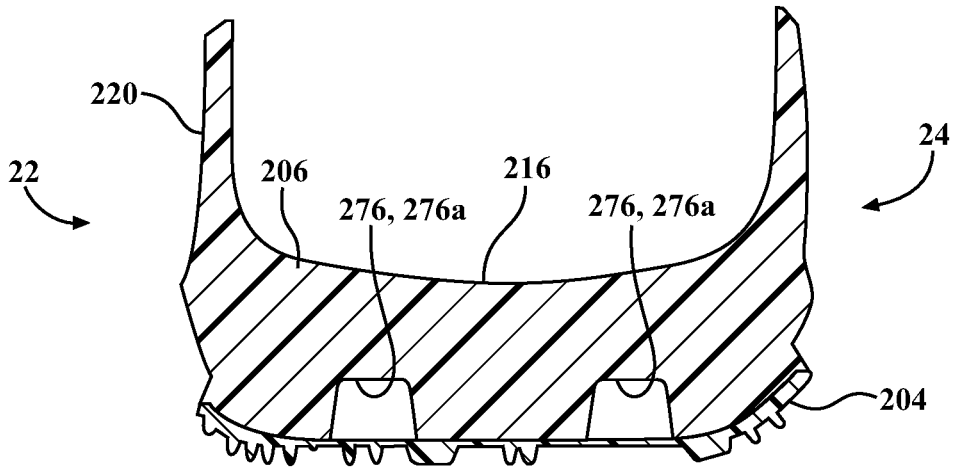
FIG. 13 is a cross-sectional view of the sole structure of FIG. 8 taken along Line 13-13 of FIG. 8.

FIG. 11 shows the cross-bead 310 disposed within the anterior leg 280*c* of the cross-groove 280, wherein the cross-bead 310 extends upwardly so as to be disposed between the lateral bladder 248 and the medial bladder 250. FIG. 11 also illustrates the outsole 204 being fixed directly to the bottom surface 244 of the cushioning arrangement 208, in particular, the lateral bladder 248 and the medial bladder 250. The second barrier layer 254 is a generally planar surface and pressed against the planar surface of the intermediate surface 232 of the foam element 206, and the intermediate wall 240 separates the lateral bladder 248 from the medial bladder 250. FIG. 12 depicts a cross-sectional view showing the wings 308 of the posterior outsole 306 spaced apart from the finger portion 316 of the anterior outsole 304 by a distance defined by the width of the V-shaped groove 270. FIG. 12 also depicts how the top surface of the midfoot shank 296 is flush with the top surface 216 of the foam element 206 so as to form a continuous and virtually contiguous surface. FIG. 13 depicts the posterior holes 276 which are covered by the anterior outsole 304. FIGS. 12 and 13 also illustrates how the anterior segment 228 defines the cushion for the heel region 16 and mid-foot region 14 of the sole structure 200.

Figure 8:
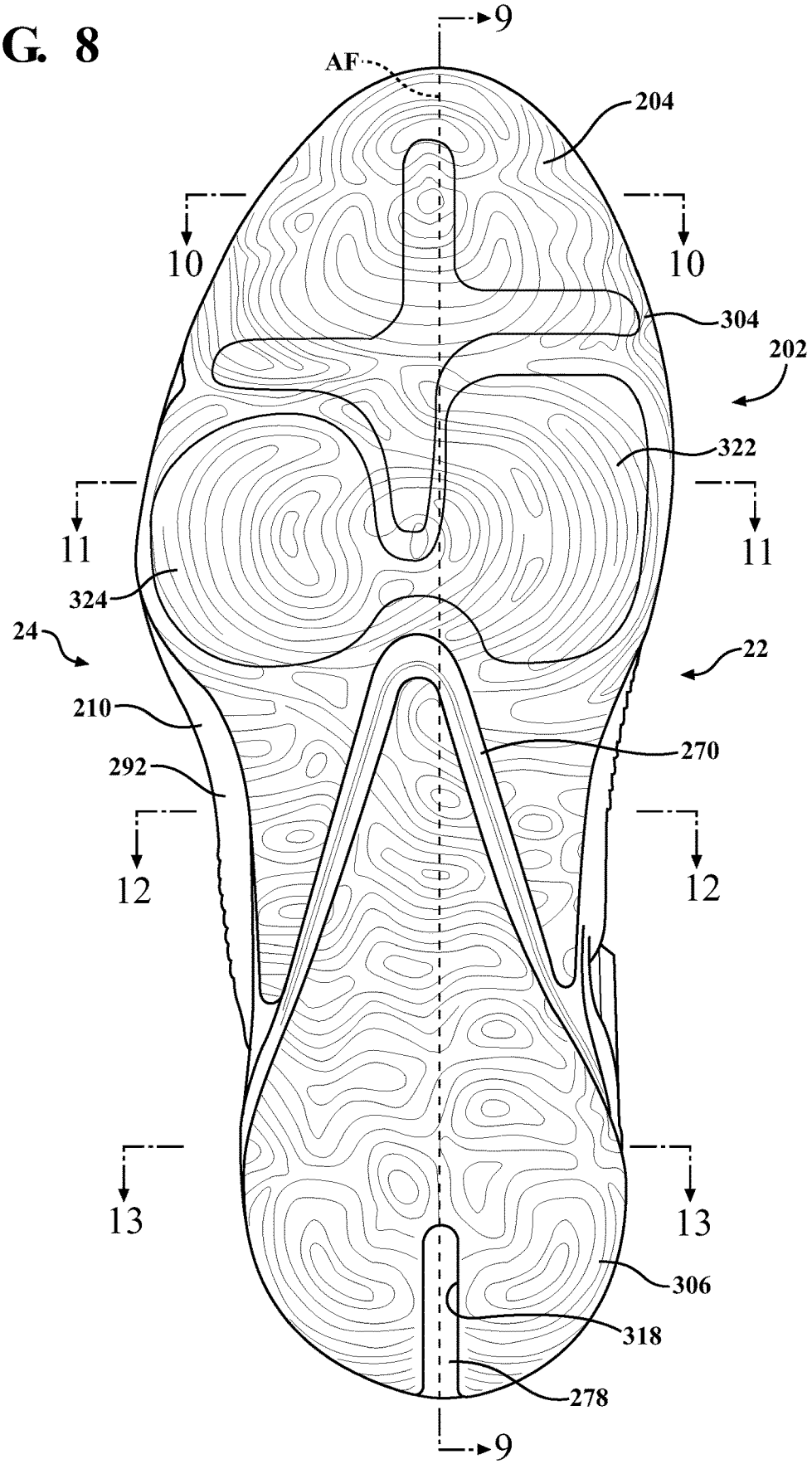
FIG. 8 is a bottom view of the sole structure of FIG. 7.

With reference again to FIG. 8, the anterior outsole 304 and the posterior outsole 306 is overmolded onto the corresponding anterior segment 228 and the posterior segment 230 of the foam element 206. When assembled, the anterior outsole 304 and the posterior outsole 306 are spaced apart from each other a distance defined by the V-shaped groove 270 of the foam element 206. FIG. 8 further depicts the geometry of the sole structure 200 at the ball portion 12B of the forefoot region 12. In particular, the sole structure 200 includes a medial ball support 322 and a lateral ball support 324. The medial ball support 322 is disposed on the medial side 22 of the sole structure 200 and the lateral ball support 324 is disposed on the lateral side 24 of the sole structure 200. The ground engaging surface 30 and the profile of the foam element 206 corresponding to the ground engaging surface 30 of the medial ball support 322 and the lateral ball support 324 are shaped differently from each other. The medial ball support 322 defines a generally rectangular planar contacting surface which is dimensioned to cover the entirety of the metatarsals disposed along the medial side 22 of the foot. The lateral ball support 324 defines a generally circular planar contacting surface. The dimensions of the medial ball support 322 and the lateral ball support 324 are dimensioned to provide a cushion for the foot during athletic moves such as a planting the foot in a lateral direction, jumping, running and the like.

The following Clauses provide exemplary configurations for a bladder for an article of footwear described above.

Clause 1: A sole structure for an article of footwear having a heel region, a mid-foot region, a forefoot region, an interior region, and a peripheral region, the sole structure comprising a foam element extending from the forefoot region to the heel region. The foam element includes a top surface and a bottom surface formed on an opposite side of the foam element from the top surface. The foam element includes a recess formed in the bottom surface in the forefoot region. The sole structure further includes a cushioning arrangement disposed in the recess of the foam element and has a proximal end adjacent to the bottom surface of the foam element and a distal end formed on an opposite side of the cushioning arrangement than the proximal end, the cushioning arrangement including at least one medial bladder proximate to a medial side of the sole structure and at least one lateral bladder proximate to a lateral side of the sole structure.

Clause 2: The sole structure of Clause 1, wherein the at least one medial bladder is offset from the at least one lateral bladder along a longitudinal direction of the sole structure.

Clause 3: The sole structure of Clause 1, wherein the cushioning arrangement includes at least one chamber having a tensile member disposed therein.

Clause 4: The sole structure of Clause 1, wherein the recess includes an intermediate surface opposing the at least one medial bladder and the at least one lateral bladder.

Clause 5: The sole structure of Clause 4, wherein the at least one medial bladder and the at least one lateral bladder each include a first barrier layer and a second barrier layer joined to each other to define a chamber, wherein the second barrier layer is planar and the intermediate surface of the recess is planar.

Clause 6: The sole structure of Clause 1, wherein the foam element has a heel thickness extending between the top surface and the bottom surface of the heel region of the foam element, the heel thickness being greater than a thickness of the cushioning arrangement.

Clause 7: The sole structure of Clause 1, further including a lateral support, wherein the foam element includes a lateral recess disposed on the lateral side of the sole structure and extending from the forefoot region to the mid-foot region, wherein the lateral support is seated within the lateral recess.

Clause 8: The sole structure of Clause 7, wherein the lateral support includes a base support and a lateral wall, the base support attached to the bottom surface of the foam element, wherein the lateral wall includes an elongated portion extending from the lateral wall to a posterior end of the sole structure.

Clause 9: The sole structure of Clause 1, further comprising an outsole having an inner surface and an outer surface formed on an opposite side of the outsole than the inner surface, the outer surface defining a ground-engaging surface of the sole structure.

Clause 10: The sole structure of Clause 9, wherein the outsole includes an anterior outsole and a posterior outsole spaced apart from the anterior outsole.

Clause 11: The sole structure of Clause 10, wherein the anterior outsole includes a pair of wings spaced apart from each other and extending from a lateral side and a medial side of the anterior outsole, each of the pair of wings tapering to a point.

Clause 12: The sole structure of Clause 11, wherein the posterior outsole includes a heel portion and a finger portion, the finger portion tapering away from the heel portion.

Clause 13: The sole structure of Clause 12, wherein the heel portion of the posterior outsole includes a heel slit.

Clause 14: The sole structure of Clause 13, wherein the heel slit is open at a distal end of the heel portion and generally bisects the heel portion along a width of the heel portion.

Clause 15: The sole structure of Clause 14, wherein the outsole is overmolded and encompasses each of the foam element, and cushioning arrangement.

Clause 16: A sole structure for an article of footwear having a heel region, a mid-foot region, a forefoot region, an interior region, and a peripheral region, the sole structure comprising a foam element, a medial bladder, a lateral bladder and an outsole. The foam element extends from the forefoot region to the heel region and includes a top surface and a bottom surface formed on an opposite side of the foam element from the top surface. The foam element includes a recess formed in the bottom surface in the forefoot region, the medial bladder is proximate to a medial side of the sole structure and the lateral bladder is proximate to a lateral side of the sole structure. The medial bladder and the lateral bladder are disposed within the recess. The outsole includes an inner surface and an outer surface formed on an opposite side of the outsole than the inner surface. The outer surface defines a ground-engaging surface of the sole structure, wherein the outsole includes an anterior outsole and a posterior outsole spaced apart from the anterior outsole.

Clause 17: The sole structure of Clause 16, wherein the anterior outsole includes a pair of wings spaced apart from each other and extending from a lateral side and a medial side of the anterior outsole, each of the pair of wings tapering to a point.

Clause 18: The sole structure of Clause 17, wherein the posterior outsole includes a heel portion and a finger portion, the finger portion tapering away from the heel portion, the heel portion of the posterior outsole includes a heel slit.

Clause 19: The sole structure Clause 18, wherein the heel slit is open at a distal end of the heel portion and generally bisects the heel portion along a width of the heel portion.

Clause 20: The sole structure of Clause 19, wherein the outsole is overmolded and encompasses each of the foam element, and cushioning arrangement.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a foam element including a top surface, a bottom surface formed on an opposite side of the foam element than the top surface, and a peripheral surface extending between the top surface and the bottom surface;

a first cushion including a first surface attached to the bottom surface of the foam element, a second surface formed on an opposite side of the first cushion than the first surface, and a sidewall extending between the first surface and the second surface; and a support including a first portion received entirely within a groove formed in the peripheral surface of the foam element and including an elongated projection extending in a direction away from a ground-engaging surface of the sole structure and in a direction inwardly and a second, base portion extending from the first portion between the second surface of the first cushion and the ground-engaging surface of the sole structure, the second, base portion having a width that is greater than a width of the first portion, the support extending over the sidewall of the first cushion.

2. The sole structure of claim 1, further comprising an outsole defining the ground-engaging surface, the support extending between the second surface of the first cushion and the outsole.

3. The sole structure of claim 1, wherein the first portion of the support extends from a forefoot region of the sole structure to a heel region of the sole structure.

4. The sole structure of claim 1, wherein the support is substantially flush with the peripheral surface of the foam element.

5. The sole structure of claim 1, wherein the first cushion is a fluid-filled chamber.

6. The sole structure of claim 5, further comprising a second cushion disposed adjacent to the first cushion.

7. The sole structure of claim 6, wherein the first cushion is disposed adjacent to a lateral side of the sole structure and further from an anterior end of the sole structure than the second cushion.

8. The sole structure of claim 7, wherein the second cushion is a fluid-filled chamber.

9. An article of footwear incorporating the sole structure of claim 1.

10. A sole structure for an article of footwear, the sole structure comprising:

a foam element including a top surface, a bottom surface formed on an opposite side of the foam element than the top surface, and a peripheral surface extending between the top surface and the bottom surface;

a first cushion including a first surface attached to the bottom surface of the foam element, a second surface formed on an opposite side of the first cushion than the first surface, and a sidewall extending between the first surface and the second surface;

an outsole defining a ground-engaging surface of the sole structure, the first cushion being disposed between the outsole and the foam element; and a support including a first portion attached to and received entirely within a groove formed in the peripheral surface of the foam element and including an elongated projection extending in a direction away from the ground-engaging surface of the sole structure, extending in a direction from a forefoot region of the sole structure toward a heel region of the sole structure, and in a direction inwardly, the support including a second portion extending between the second surface of the first cushion and the outsole, the second portion having a width that is greater than a width of the first portion.

11. The sole structure of claim 10, wherein the support includes a higher rigidity than the foam element.

12. The sole structure of claim 10, wherein the support is disposed at a lateral side of the sole structure.

13. The sole structure of claim 10, wherein the first portion of the support extends from the forefoot region of the sole structure to the heel region of the sole structure.

14. The sole structure of claim 10, wherein the support is substantially flush with the peripheral surface of the foam element.

15. The sole structure of claim 10, wherein the first cushion is a fluid-filled chamber.

16. The sole structure of claim 15, further comprising a second cushion disposed adjacent to the first cushion.

17. The sole structure of claim 16, wherein the first cushion is disposed adjacent to a lateral side of the sole structure and further from an anterior end of the sole structure than the second cushion.

18. The sole structure of claim 17, wherein the second cushion is a fluid-filled chamber.

19. An article of footwear incorporating the sole structure of claim 10.

* * * * *